US010217421B2

(12) United States Patent
Meng et al.

(10) Patent No.: US 10,217,421 B2
(45) Date of Patent: Feb. 26, 2019

(54) DISPLAY PANEL, DISPLAY DEVICE AND DISPLAY CONTROL METHOD

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhiming Meng, Beijing (CN); Weihao Hu, Beijing (CN); Rui Guo, Beijing (CN); Luqiang Guo, Beijing (CN); Chao Zhang, Beijing (CN); Jinhui Cheng, Beijing (CN); Zhimin Ma, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 314 days.

(21) Appl. No.: 15/248,049

(22) Filed: Aug. 26, 2016

(65) Prior Publication Data

US 2017/0221431 A1 Aug. 3, 2017

(30) Foreign Application Priority Data

Jan. 28, 2016 (CN) ..... 2016 1 0058966

(51) Int. Cl.
*G09G 3/34* (2006.01)

(52) U.S. Cl.
CPC ... *G09G 3/3413* (2013.01); *G09G 2300/0452* (2013.01); *G09G 2310/024* (2013.01); *G09G 2310/0235* (2013.01)

(58) Field of Classification Search
CPC ..... G09G 2300/0452; G09G 3/3413; G09G 2310/0235; G09G 2310/024
See application file for complete search history.

(56) References Cited

U.S. PATENT DOCUMENTS

2008/0266312 A1* 10/2008 Chen ..... G09G 3/3413 345/589
2009/0121985 A1 5/2009 Kang et al.
2012/0092360 A1* 4/2012 Kang ..... G09G 3/3413 345/589
2012/0194493 A1 8/2012 Soto
(Continued)

FOREIGN PATENT DOCUMENTS

CN 102622970 A 8/2012
CN 102901012 A 1/2013
(Continued)

OTHER PUBLICATIONS

The First Chinese Office Action dated Sep. 5, 2017; Appl. 201610058966.X.

*Primary Examiner* — Abbas I Abdulselam
(74) *Attorney, Agent, or Firm* — Ladas & Parry LLP

(57) ABSTRACT

A display panel, a display device and a display control method are disclosed. The display panel comprises a backlight module and a display substrate, wherein the backlight module comprises a plurality of backlight sources having different colors, the display substrate comprises a plurality of pixels, and each of the pixels comprises a plurality of sub-pixels having different colors; sub-pixels of at least one color and backlight sources having the same color are configured to be turned-on during a same time period.

17 Claims, 6 Drawing Sheets

(56) References Cited

U.S. PATENT DOCUMENTS

| | | | | |
|---|---|---|---|---|
| 2014/0119053 | A1 | 5/2014 | Yao | |
| 2014/0254141 | A1* | 9/2014 | McRae | G02F 1/133602 362/97.2 |
| 2016/0187725 | A1 | 6/2016 | Ma | |
| 2016/0247464 | A1* | 8/2016 | Kang | G09G 3/3611 |

FOREIGN PATENT DOCUMENTS

| | | | |
|---|---|---|---|
| CN | 103309087 | A | 9/2013 |
| CN | 103956144 | A | 7/2014 |

* cited by examiner

DISPLAY PANEL, DISPLAY DEVICE AND DISPLAY CONTROL METHOD

FIELD OF THE ART

Embodiments of the invention relate to the technical field of display technologies, more particularly, to a display panel, a display device and a display control method.

BACKGROUND

Backlight sources of display devices are generally white light backlight sources. The white light emitted by a white light backlight source enters a color filter substrate through a liquid crystal layer, and then exits from a color filter layer of the color filter substrate. Due to the light filtering effect of the color filter layer, a red filter layer filters out non-red light in the white light in a region corresponding to the red sub-pixels, a green filter layer filters out non-green light in the white light in a region corresponding to the green sub-pixels, and a blue filter layer filters out non-blue light in the white light in a region corresponding to the blue sub-pixels. That is, a significant part of the white light emitted by the backlight sources will be filtered by the color filter layer, causing a color gamut of the light finally emitted by the display device to be smaller than that of the original light emitted by the backlight sources.

SUMMARY

According to a first aspect of the present invention, there is provided a display panel which comprises a backlight module and a display substrate, wherein the backlight module comprises a plurality of backlight sources having different colors, the display substrate comprises a plurality of pixels, and each of the pixels comprises a plurality of sub-pixels having different colors; sub-pixels of at least one color and backlight sources having the same color are configured to be turned-on during a same time period.

According to a second aspect of the present invention, there is provided a display device which comprises the above display panel.

According to a third aspect of the present invention, there is provided a display control method, wherein the display panel comprises a backlight module and a display substrate, the backlight comprises a plurality of backlight sources having different colors, the display substrate comprises a plurality of pixels, and each of the pixels comprises a plurality of sub-pixels having different colors; the method comprises turning on sub-pixels of at least one color and backlight sources having the same color in a same time period.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

Figure 1:
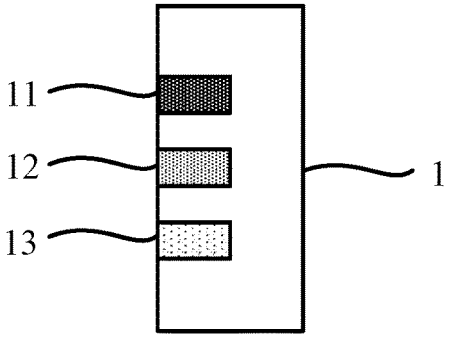
FIG. 1 schematically illustrates a backlight module in accordance with an embodiment of the invention.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "plurality of" refers to two or more than two. The display substrate may be any substrate including a pixel structure, such as an array substrate, a COA substrate. For illustration purpose, an array substrate is taken as an example in following embodiments.

An embodiment of the invention provides a display panel comprising a backlight module and a display substrate. The backlight module comprises a plurality of backlight sources having different colors, the display substrate comprises a plurality of pixels, and each of the pixels comprises a plurality of sub-pixels having different colors; sub-pixels of at least one color and backlight sources having the same color are configured to be turned-on during a same time period.

In at least some of the embodiments, each pixel comprises sub-pixels of three colors (such as red, green and blue) or more than three colors (such as red, green, blue and white). Backlight sources in the embodiments of the invention can emit light having a same color as that of sub-pixels. When sub-pixels of at least one color of a substrate are turned on, the backlight sources of the same color can be also turned on. As a color filter layer has a same color as that of corresponding sub-pixels, light emitted by backlight sources having the same color as that of the sub-pixels will not be filtered out by the color filter layer, thus increasing a color gamut of sub-pixels of the color. As an example, red sub-pixels correspond to a red color filter layer. As the light emitted by backlight sources is red light, the red light will not be filtered out by the red color filter layer, thereby increasing a color gamut of red sub-pixels.

In at least some of the embodiments, a display panel further comprises:

a control unit configured for analyzing display signal so as to determine sub-pixels of N colors needing to be turned on in a frame period (i.e., a period of time corresponding to one frame, and it may includes several time periods), that is, to determine sub-pixels of N colors needing to be turned on among sub-pixels of a plurality of colors), and turning on sub-pixels of the nth color of N colors and backlight sources having the same color in at least one time period of K time periods during the frame period, wherein $1 \leq n \leq N$, $K \geq 1$, and n, N and K are all integers.

In the embodiment of the invention, when the nth color is displayed in a certain time period during a period of time corresponding to one frame, sub-pixels of the nth color and backlight sources of the nth color (i.e., the same color as that of sub-pixels) are turned on. As the color of the light emitted by the backlight sources of the nth color is the same as that of the sub-pixels of the nth color, that is, the color of the emitted light is the same as that of a color filter layer of the sub-pixels of the nth color, the color filter layer will not filter out the light emitted by the backlight sources, thereby increasing a color gamut of the nth color displayed on the display panel.

In at least some of the embodiments, K=N, and the control unit turns on sub-pixels of the nth color and backlight sources of the nth color in the nth time period.

In the embodiment of the invention, it is possible to display N colors in N time periods respectively, thereby increasing the color gamut of every color displayed on the display panel.

Figure 2:
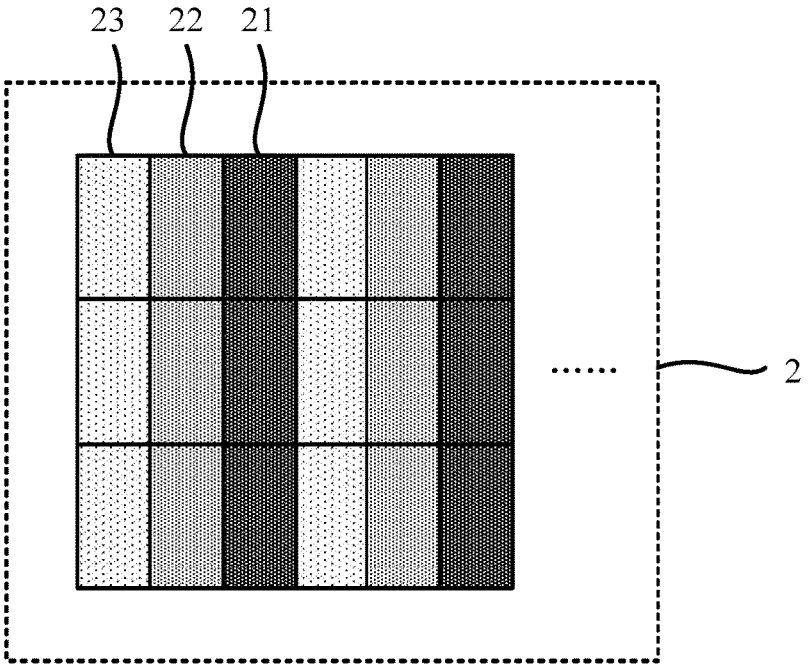
FIG. 2 schematically illustrates an array substrate in accordance with an embodiment of the invention.

Taking the situation of N=3 and K=3 as an example, as illustrated in FIG. 1 and FIG. 2, it is needed to turn on red sub-pixels 21, green sub-pixels 22 and blue sub-pixels 23 during the frame period, and a backlight module 1 comprises red backlight sources 11, green backlight sources 12 and blue backlight sources 13. In the embodiment of the invention, it is possible to control the red sub-pixels 21 and red backlight sources 11 to be turned on in the first time period, control the green sub-pixels 22 and green backlight sources 12 to be turned on in the second time period, and control the blue sub-pixels 23 and blue backlight sources 13 to be turned on in the third time period, thereby increasing the color gamut of the three colors of red, green and blue.

In at least some of the embodiments, the backlight module comprises backlight sources of N colors, and each pixel comprises sub-pixels of N colors. As illustrated in FIG. 1, the backlight module 1 comprises backlight sources of three colors. As illustrated in FIG. 2, each pixel of an array substrate 2 comprises sub-pixels of three colors.

In at least some of the embodiments, K>N, and sub-pixels of the nth color of N colors and backlight sources of the nth color of N colors are controlled to be turned on in the plurality of time periods of K time periods.

In the embodiment of the invention, it is possible to display one color only in at least one time period during the frame period so as to highlight the color in each frame displayed.

In at least some of the embodiments, the control unit turns on sub-pixels of the nth color of N colors and backlight sources of the nth color of N colors in a plurality of nonadjacent time periods of K time periods, and turns on sub-pixels of other colors and backlight sources having the same color as that of the sub-pixels in other time periods.

In the embodiment of the invention, the display panel can emit light of the nth color in a plurality of nonadjacent time periods, thus increasing a frequency of the transformation from displaying the nth color to displaying other colors, thereby increasing display uniformity of various colors in a frame of picture.

In at least some of the embodiments, the time periods of K time periods are equal to one another so as to conveniently control a display length of each color in a frame of picture.

In at least some of the embodiments, K=4, N=3, sub-pixels of three colors comprise red sub-pixels, green sub-pixels and blue sub pixels, and the control unit turns on blue sub-pixels and blue backlight sources in two of four time periods and turns on red sub-pixels and red backlight sources as well as green sub-pixels and green backlight sources respectively in the other two time periods.

As illustrated in FIG. 1 and FIG. 2, the backlight module 1 comprises red backlight sources 11, green backlight sources 12 and blue backlight sources 13. The array substrate 2 comprises a plurality of pixels, and each of the pixels comprises a red sub-pixel 21, a green sub-pixel 22 and a blue sub-pixel 23.

Figure 3:
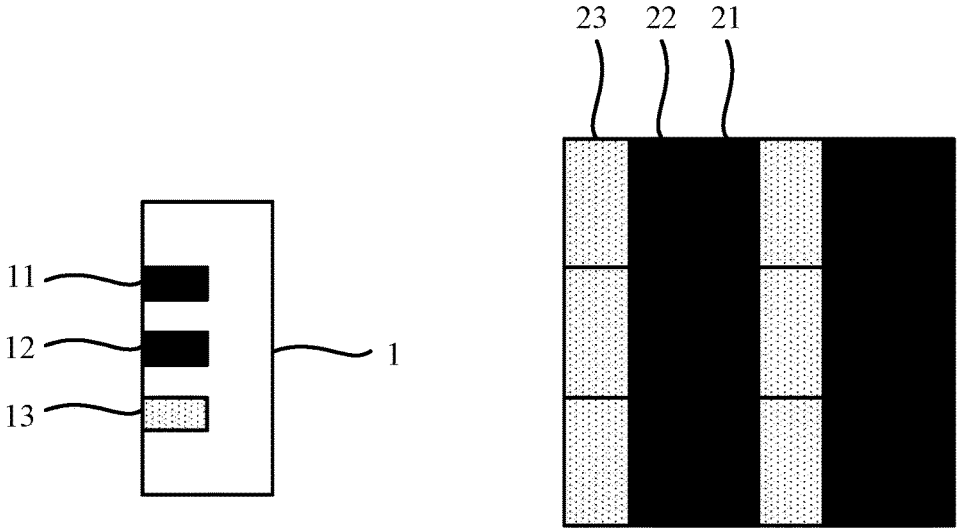
FIG. 3 schematically illustrates a relationship between backlight sources and sub-pixels in accordance with an embodiment of the invention.
Figure 4A:
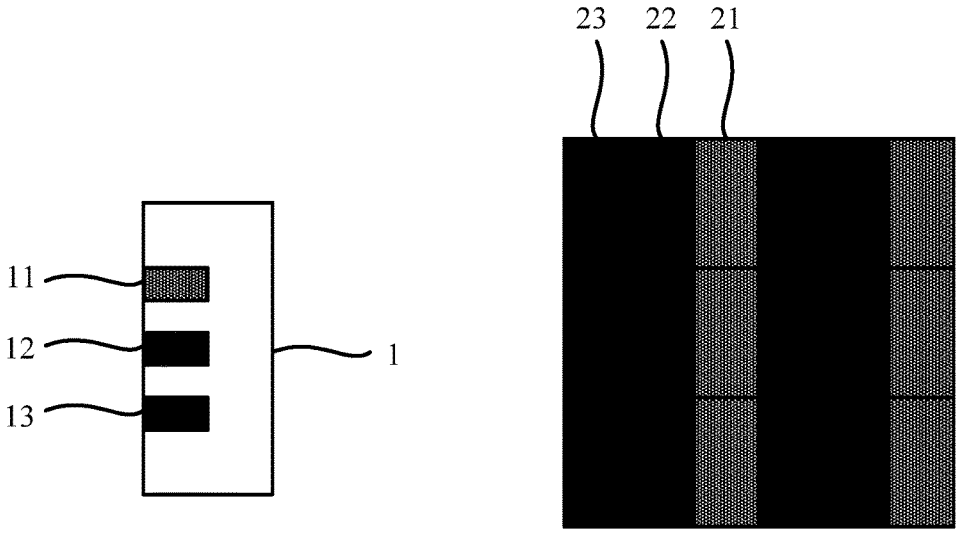
FIG. 4*a* and FIG. 4*b* schematically illustrate a relationship between backlight sources and sub-pixels in accordance with another embodiment of the invention.
Figure 4B:
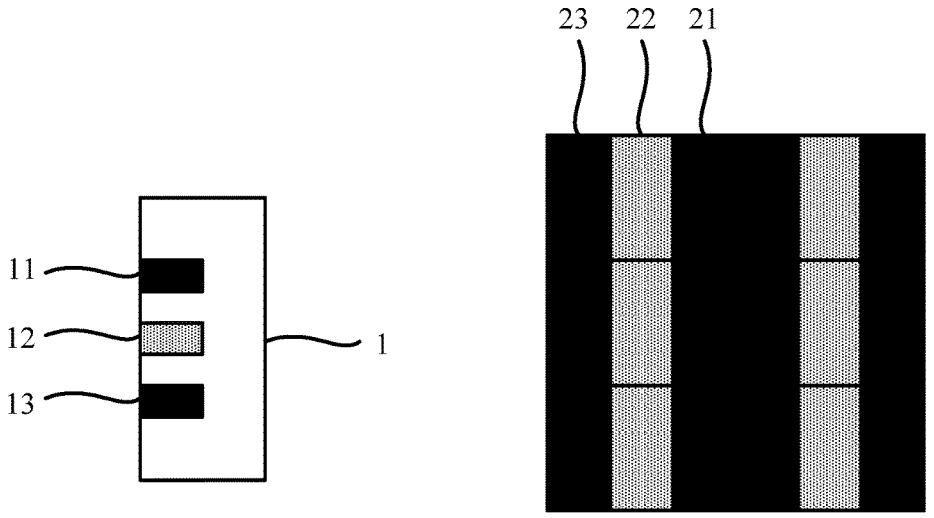

For example, the red sub-pixel 21, the green sub-pixel 22 and the blue sub-pixel 23 in each of pixels need to be turned on during a frame period. As illustrated in FIG. 3, it is possible to control the blue sub-pixels 23 and blue backlight sources 13 to be turned on in the first time period and the third time period. As illustrated in FIG. 4*a*, it is possible to control the red sub-pixels 21 and red backlight sources 11 to be turned on in the second time period. As illustrated in FIG. 4*b*, it is possible to control the green sub-pixels 22 and green backlight sources 12 to be turned on in the fourth time period.

It can be contemplated that other control method may also be applied. As an example, it is possible to control the blue sub-pixels 23 and blue backlight sources 13 to be turned on in the second time period and the fourth time period, control the red sub-pixels 21 and red backlight sources 11 to be turned on in the first time period, and control the green sub-pixels 22 and green backlight sources 12 to be turned on in the third time period.

As the plurality of time periods are equal to one another, as a result, during the frame period of a frame, the time for lighting blue sub-pixels is two time periods, the time of lighting green and red sub-pixels is one time periods respectively, that is, the time for lighting blue sub-pixels is longer than that of green sub-pixels and red sub-pixels, thus the color gamut of blue light is increased at the greatest extent.

Furthermore, in the above embodiment of the invention, when controlling the blue sub-pixels 23 and blue backlight sources 13 to be turned on in the first time period and the third time period, it is also possible to control the red sub-pixels 21, red backlight sources 11, the green sub-pixels 22 and green backlight sources 12 to be turned on in the first time period and the third time period. Although red light and green light are emitted together in half a frame period, the amounts of red and green light emitted by the color filter layer can still be increased in comparison with mixing the red, green and blue light together as white light and emitting the white light in conventional technology (in conventional technology, the red light and green light emitted from the blocking layer account for ⅓ of the white light emitted from the backlight sources respectively, however, in the embodiment of the invention, as the backlight sources emit only red and green lights in the second time period, the red light and green light emitted from the blocking layer account for ½ of total amount of the emitted light respectively), thereby increasing the color gamut of red light and green light.

Furthermore, as a luminance of blue light is relatively weaker than that of red light and green light in a pixel structure including red, green, and blue sub-pixels, through displaying blue color in half a frame period and displaying red and green colors in another half frame period, it is possible to increase the color gamut of display, moreover, allow the luminance of red color, green color and blue color in each frame displayed to be relatively uniform.

In at least some of the embodiments, backlight sources of each of colors comprise J backlight sub-sources, the display substrate comprises J regions parallel to a scan direction, a jth backlight sub-source is configured for providing light source for a jth region, each of time periods comprises J sub time periods which are equal to one another.

For example, the control unit controls a jth blue backlight sub-source to be turned on in a jth sub time period of the time period which the blue sub-pixels are turned on; and controls a jth red backlight sub-source and jth green backlight sub-source to be turned on in a jth sub-time period of the time period which the red sub-pixels and the green sub-pixels are turned on, wherein $1 \leq j \geq J$, and j and J are all integers.

In the embodiment of the invention, each of the sub-pixels of the array substrate is turned on through row scanning, that is, the sub-pixels are turned on row by row. Because the J regions are parallel to the scan direction, moreover, the jth backlight source may be turned on in the jth sub time period and the jth backlight source provides light source for the jth region, as a result, the jth backlight source may provide light source for the sub-pixels in the jth region in the jth sub time period.

Figure 5:
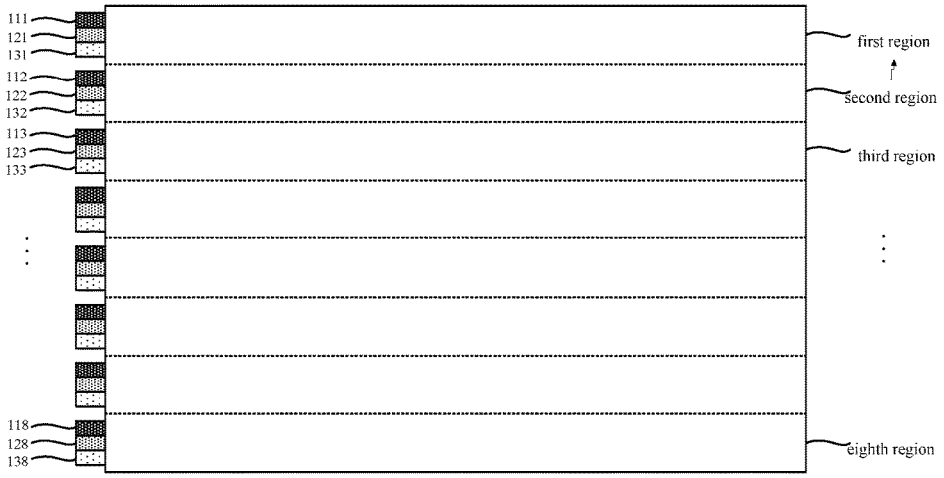
FIG. 5 schematically illustrates a position relationship between backlight sub-sources and an array substrate in accordance with an embodiment of the invention.

As an example illustrated in FIG. 5, when J=8, backlight source of each of colors comprises 8 backlight sub-sources (as an example, red backlight sub-sources comprise first red backlight sub-sources 111, second red backlight sub-sources 112, third backlight sub-sources 113 up to eighth backlight sub-sources 118; green backlight sources comprise first green backlight sub-sources 121, second green backlight sub-sources 122, third green backlight sub-sources 123 up to eighth green backlight sub-sources 128; and blue backlight sources comprise first blue backlight sub-sources 131, second blue backlight sub-sources 132, third blue backlight sub-sources 133 up to eighth blue backlight sub-sources 138). The array substrate comprises 8 regions parallel to the scan direction. When switching to turn on sub-pixels of different colors, such as from the 8th sub time period of the time period which the blue sub-pixels are turned on to the 1th sub time period of the time period which the red and green sub-pixels are turned on, because the eighth blue backlight sub-sources 138 provide blue light sources for the 8th region in the 8th time period, the first red backlight sub-sources 111 and the first green backlight sub-sources 121 provide red and green light sources for the 1th region in the 1th sub time period, and a distance from the 1th region to the 8th region is relatively far, it may stagger the region displaying blue and the region displaying green and red to a great extent, thereby decreasing persistence of vision.

Figure 6:
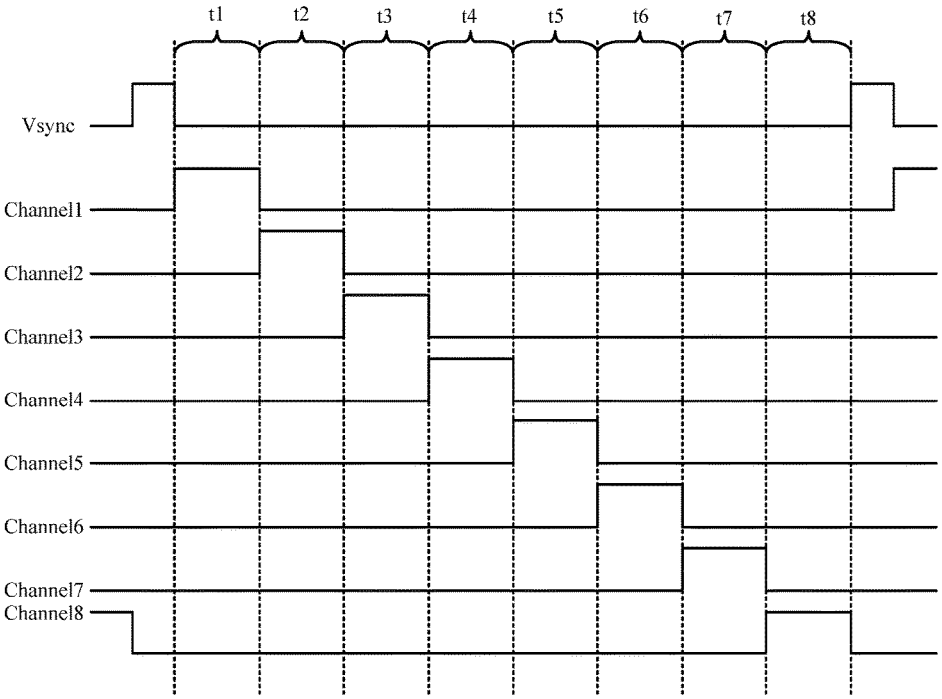
FIG. 6 schematically illustrates a time sequence of a plurality of backlight sources in accordance with an embodiment of the invention.

As an example illustrated in FIG. 6, J=8, that is, the red backlight sources of the backlight module comprise eight red backlight sub-sources, the green backlight sources comprise eight green backlight sub-sources and the blue backlight sources comprise eight blue backlight sub-sources. The numerals t1 to t8 represent time periods. When the control unit transmits Vsync signals to the backlight module and the array substrate, the backlight module and the array substrate determine the colors needed to display, the backlight module turns on backlight sources of corresponding colors, and the array substrate turns on sub-pixels of same colors.

As an example, when the blue backlight sources are needed to be turned on, the backlight module transmits channel (channel1 to channel8) signals to eight blue backlight sub-sources therein respectively, for example, the 3th blue backlight sub-sources is turned on after receiving the channel3 signal. When the control unit transmits the next Vsync signal to the backlight module and array substrate, the backlight module may turn on red and green backlight sources and the array substrate turns on the red and green sub-pixels.

Figure 7:
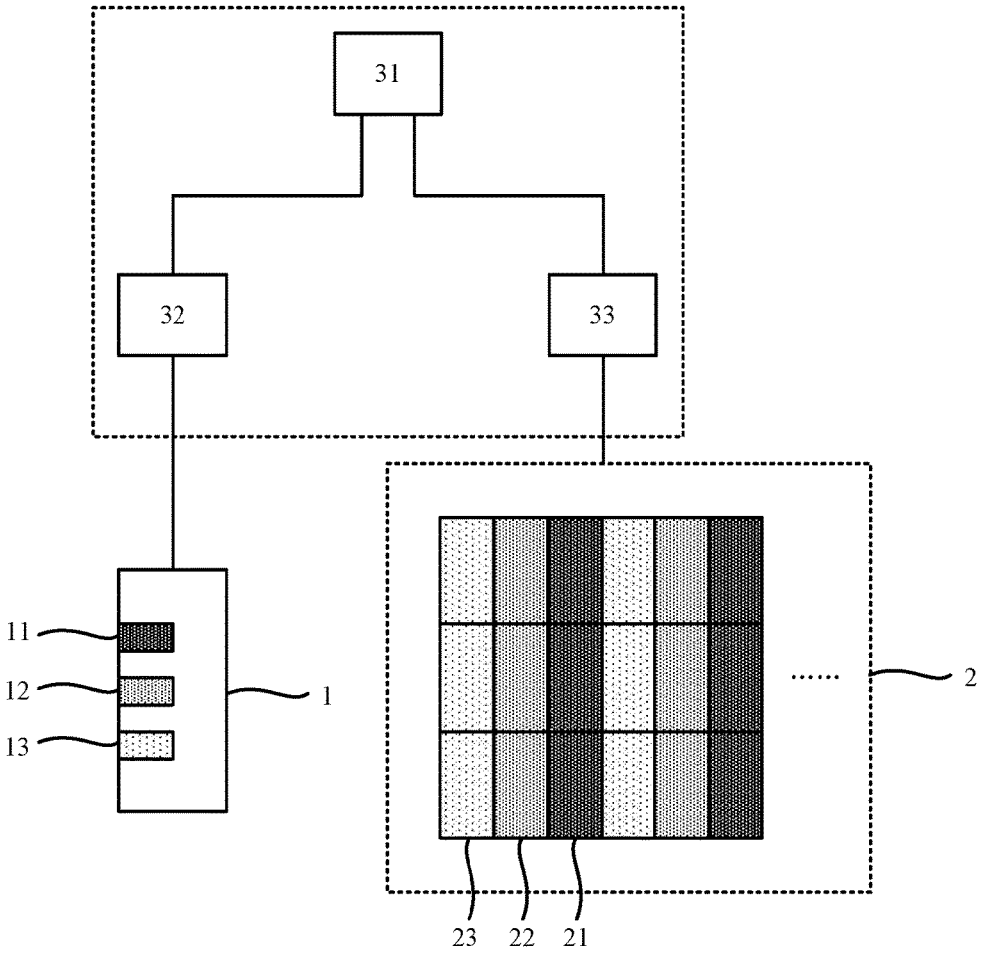
FIG. 7 illustrates a schematic diagram of control of a backlight module and an array substrate in accordance with an embodiment of the invention.

As illustrated in FIG. 7, in at least some of the embodiments, the control unit 3 comprises:

a processor 31 configured for analyzing the display signal so as to determine sub-pixels of N colors needing to be turned on during the frame period corresponding to a frame and transmitting synchronizing signal to a converter 32 and a timing controller 33;

the converter 32 configured for receiving the synchronizing signal, turning on backlight sources of the nth color of N colors in one of K time periods during the frame period, and turning on backlight sources of other colors in other time periods;

the timing controller 33 configured for receiving the synchronizing signal, turning on sub-pixels of the nth color of N colors in one of K time periods during the frame period, and turning on sub-pixels of other colors in other time periods.

In the embodiment of the invention, it is possible to control the backlight module and pixels synchronously, such that when sub-pixels of some color in the pixels are turned on, backlight sources having the same color as that of the sub-pixels in the backlight module is turned on synchronously, thereby realizing an optimal light emission effect.

Figure 8:
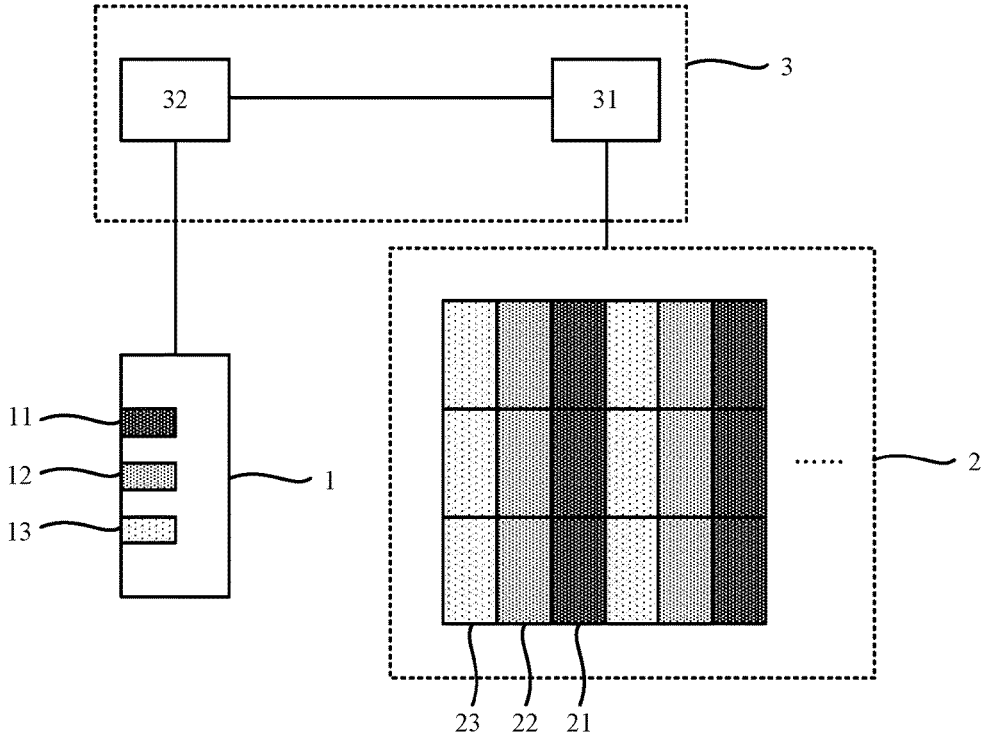
FIG. 8 illustrates a block diagram of a backlight module and an array substrate in accordance with another embodiment of the invention.

As illustrated in FIG. 8, in at least some of the embodiments, the control unit comprises:

a processor 31 configured for analyzing the display signal so as to determine sub-pixels of N colors needing to be turned on during the frame period corresponding to a frame, transmitting synchronizing signal to a converter, and turning on sub-pixels of the nth color of N colors in one of K time periods during the frame period while transmitting the synchronizing signal, and turning on sub-pixels of other colors in other time periods;

the converter 32 configured for receiving the synchronizing signal, and turning on backlight sources of nth color of N colors in one of K time periods during the frame period and turning on backlight sources of other colors in other time periods.

In the embodiment of the invention, a processor (such as FPGA) may be employed to realize the functions of the timing controller (Tcon), thereby decreasing the space occupied by hardware structure of the display panel.

An embodiment of the invention further provides a display device comprising the above display panel.

It is noted that, the display device in the embodiment of the invention may be for example an e-paper, a mobile phone, tablet PC, a television, a laptop computer, a digital photo-frame, a navigators or any products or components with a display function.

An embodiment of the invention further provides a display control method for a display panel, wherein the display panel comprises a backlight module and an array substrate, the backlight module comprises a plurality of backlight sources having different colors, the array substrate comprises a plurality of pixels, and each of the pixels comprises a plurality of sub-pixels having different colors, the method comprises:

turning on sub-pixels of at least one color and backlight sources having the same color in a same time period.

Figure 9:
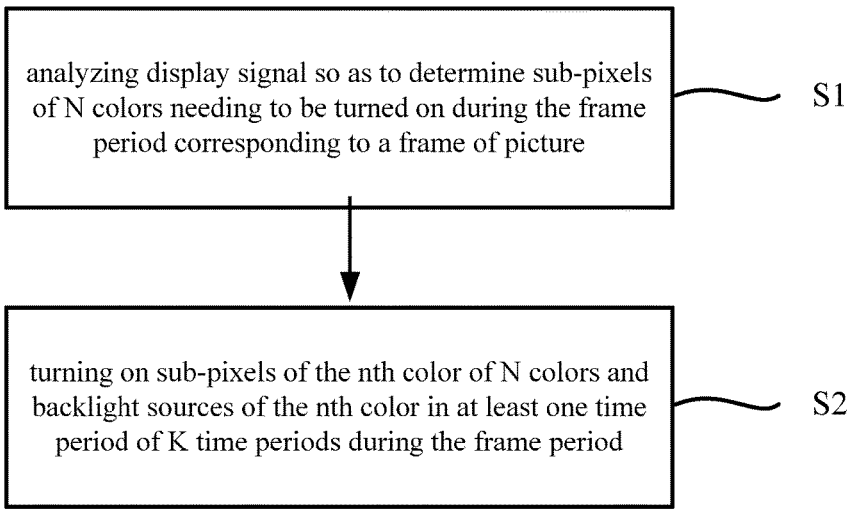
FIG. 9 schematically illustrates a flow chart of a display control method for a display panel in accordance with an embodiment of the invention.

As illustrated in FIG. 9, in at least some of the embodiments, before turning on sub-pixels of at least one color, the method further comprises:

S1, analyzing display signal so as to determine sub-pixels of N colors needing to be turned on during the frame period corresponding to a frame of picture.

In this case, the step of turning on sub-pixels of at least one color and backlight sources having the same color in a same time period comprises:

S2, turning on sub-pixels of the nth color of N colors and backlight sources of the nth color (that is, the backlight sources have the same color as that of the sub-pixels) in at least one time period of K time periods during the frame period, wherein $1 \leq n \leq N$, $K \geq 1$, and n, N and K are all integers.

In at least some of the embodiments, and the step of turning on sub-pixels of the nth color of N colors and backlight sources of the nth color in at least one time period of K time periods of the frame period comprises: turning on sub-pixels of the nth color of N colors and backlight sources of the nth color in the nth time period.

In at least some of the embodiments, K>N, and the step of turning on sub-pixels of the nth color of N colors and backlight sources of the nth color in at least one time period of K time periods of the frame period comprises: turning on sub-pixels of the nth color of N colors and backlight sources of the nth color in a plurality of time periods of K time periods.

In at least some of the embodiments, the plurality of time periods is nonadjacent time periods.

In at least some of the embodiments, each of the time periods of K time periods is equal to one another.

In at least some of the embodiments, K=4, N=3, sub-pixels of three colors comprise red sub-pixels, green sub-pixels and blue sub pixels, and the step of turning on sub-pixels of the nth color of N colors and backlight sources of the nth color in a plurality of nonadjacent time periods of K time periods comprises:

turning on blue sub-pixels and blue backlight sources in two time periods of four time periods; and turning on red sub-pixels and red backlight sources as well as green sub-pixels and green backlight sources respectively in the other two time periods.

In at least some of the embodiments, backlight sources of each of colors comprise J backlight sub-sources, the display substrate comprises J regions parallel to a scan direction, a jth backlight sub-source is configured for providing light source for jth region, each of time periods comprises J sub time periods which are equal to one another, the step of turning on blue sub-pixels and blue backlight sources in two time periods of four time periods comprises:

controlling a jth blue backlight sub-source to be turned on in a jth sub time period of the time period which the blue sub-pixels are turned on, and the step of turning on red sub-pixels and red backlight sources as well as green sub-pixels and green backlight sources respectively in the other two time periods comprises:

controlling a jth red backlight sub-source and jth green backlight sub-source to be turned on in a jth sub time period of the time period which the red sub-pixels and the green sub-pixels are turned on, wherein $1 \leq j \leq J$, and j and J are all integers.

In the embodiments of the invention, when a certain color is displayed, it is possible to turn on sub-pixels of the same color and backlight sources of the same color. As the color of the emitted light is the same as that of the color filter layer of sub-pixels of the color, the color filter layer will not filter out the light from the backlight sources, thereby increasing the color gamut of the color displayed on the display panel.

The present application claims priority from Chinese Application No. 201610058966.X, filed on Jan. 28, 2016, the disclosure of which is incorporated herein by reference in its entirety.

What is claimed is:

1. A display panel, comprising a backlight module and a display substrate, wherein the backlight module comprises a plurality of backlight sources having different colors, the display substrate comprises a plurality of pixels, and each of the pixels comprises a plurality of sub-pixels having different colors; sub-pixels of at least one color and backlight sources having the same color are configured to be turned-on during a same time period, and wherein the display panel further comprises:

a control unit configured for analyzing display signal so as to determine sub-pixels of N colors needing to be turned-on during a frame period corresponding to a frame of picture, and to turn on sub-pixels of the nth color of N colors and backlight sources having the same color in at least one time period of K time periods of the frame period, wherein $1 \leq n \leq N$, $K \geq 1$, and n, N and K are all integers.

2. The display panel of claim 1, wherein K=N, and the control unit turns on sub-pixels of the nth color and backlight sources having the same color in the nth time period.

3. The display panel of claim 1, wherein K>N, and the control unit turns on sub-pixels of the nth color of the N colors and backlight sources having the same color in a plurality of time periods of the K time periods.

4. The display panel of claim 3, wherein the control unit turns on the sub-pixels of the nth color of the N colors and the backlight sources having the same color in a plurality of nonadjacent time periods of the K time periods, and turns on sub-pixels of other colors and backlight sources having the same color as that of the sub-pixels in other time periods.

5. The display panel of claim 3, wherein each of the time periods of the K time periods is equal to each other.

6. The display panel of claim 5, wherein K=4, N=3, the sub-pixels of three colors comprise red sub-pixels, green sub-pixels and blue sub pixels, the control unit turns on blue the sub-pixels and blue the backlight sources in two of the four time periods, and turns on the red sub-pixels and the red backlight sources as well as the green sub-pixels and the green backlight sources respectively in remaining two time periods.

7. The display panel of claim 6, wherein backlight sources of each of colors comprise J backlight sub-sources, the display substrate comprises J regions parallel to a scan direction, a jth backlight sub-source is configured as a light source for a jth region, each of the time periods comprises J sub time periods, the control unit controls a jth blue backlight sub-source to be turned-on in a jth sub time period of the time period in which the blue sub-pixels are turned on, and controls a jth red backlight sub-source and a jth green backlight sub-source to be turned-on in a jth sub time period of the time period which the red sub-pixels and the green sub-pixels are turned on, wherein $1 \leq j \leq J$, and j and J are both integers.

8. The display panel of claim 1, wherein the control unit comprises:

a processor, configured for analyzing display signal so as to determine sub-pixels of N colors needing to be turned-on during the frame period corresponding to a frame of picture and transmitting synchronizing signal to a converter and a timing controller;

the converter, configured for turning on backlight sources of the nth color of N colors in a time period of K time periods during the frame period and turning on backlight sources of other colors in other time periods after receiving the synchronizing signal;

the timing controller, configured for turning on sub-pixels of the nth color of N colors in a time period of K time periods during the frame period and turning on sub-pixels of other colors in other time periods after receiving the synchronizing signal.

9. The display panel of claim 1, wherein the control unit comprises:

a processor, configured for analyzing display signal so as to determine sub-pixels of N colors needing to be turned-on during the frame period corresponding to a frame of picture, transmitting synchronizing signal to a converter, and turning on sub-pixels of the nth color of N colors in a time period of K time periods during the frame period and turning on sub-pixels of other colors in other time periods while transmitting the synchronizing signal;

the converter, configured for turning on backlight sources of the nth color of N colors in a time period of K time periods during the frame period and turning on backlight sources of other colors in other time periods after receiving the synchronizing signal.

10. A display device comprising the display panel of claim 1.

11. A display control method for a display panel, wherein the display panel comprises a backlight module and a display substrate, the backlight comprises a plurality of backlight sources having different colors, the display substrate comprises a plurality of pixels, and each of the pixels comprises a plurality of sub-pixels having different colors;

the method comprises:

turning on sub-pixels of at least one color and backlight sources having the same color in a same time period, wherein before turning on sub-pixels of at least one color, the method further comprises:

analyzing display signal so as to determine sub-pixels of N colors needing to be turned-on during the frame period corresponding to a frame of picture, and wherein turning on sub-pixels of at least one color and backlight sources having the same color in a same time period comprises:

turning on sub-pixels of the nth color of N colors and backlight sources having the same color in at least one time period of K time periods of the frame period, wherein $1 \leq n \leq N$, $K \geq 1$, and n, N and K are all integers.

12. The display control method of claim 11, wherein K=N, and turning on sub-pixels of the nth color of N colors and backlight sources having the same color in at least one time period of K time periods of the frame period comprises:

turning on sub-pixels of the nth color and backlight sources having the same color in the nth time period.

13. The display control method of claim 11, wherein K>N, and turning on sub-pixels of the nth color of N colors and backlight sources having the same color in at least one time period of K time periods of the frame period comprises:

turning on sub-pixels of the nth color of N colors and backlight sources having the same color in a plurality of time periods of the K time periods.

14. The display control method of claim 13, wherein turning on sub-pixels of the nth color of N colors and backlight sources having the same color in a plurality of nonadjacent time periods of K time periods.

15. The display control method of claim 14, wherein each of the time periods of K time periods is equal to each other.

16. The display control method of claim 15, wherein K=4, N=3, and sub-pixels of three colors comprise red sub-pixels, green sub-pixels and blue sub pixels;

sherein turning on sub-pixels of the nth color of N colors and backlight sources having the same color in a plurality of nonadjacent time periods of K time periods comprises:

turning on the blue sub-pixels and the blue backlight sources in two of four time periods, and turning on the red sub-pixels and the red backlight sources as well as the green sub-pixels and the green backlight sources respectively in remaining two time periods.

17. The display control method of claim 16, wherein backlight sources of each of colors comprise J backlight sub-sources, the display substrate comprises J regions parallel to a scan direction, a jth backlight sub-source is configured for providing light source for jth region, each of time periods comprises J sub time periods;

wherein turning on blue sub-pixels and blue backlight sources in two of four time periods comprises:

controlling a jth blue backlight sub-source to be turned-on in a jth sub time period of the time period which the blue sub-pixels are turned on;

wherein turning on red sub-pixels and red backlight sources as well as green sub-pixels and green backlight sources respectively in remaining two time periods comprises:

controlling a jth red backlight sub-source and jth green backlight sub-source to be turned-on in a jth sub time period of the time period which the red sub-pixels and the green sub-pixels are turned on, wherein $1 \leq j \leq J$, and j and J are all integers.

* * * * *